US005207632A

United States Patent [19]

Brunlid

[11] Patent Number: 5,207,632

[45] Date of Patent: May 4, 1993

[54] METHOD OF OBTAINING BEND LINES ON PACKAGING MATERIAL

[75] Inventor: John-Erik Brunlid, Lund, Sweden

[73] Assignee: Tetra Alfa Holdings, Pully, Switzerland

[21] Appl. No.: 757,527

[22] Filed: Sep. 11, 1991

[30] Foreign Application Priority Data

Oct. 5, 1990 [SE] Sweden ..... 9003192

[51] Int. Cl.[5] ..... B31B 1/25; B31B 3/25; B31F 7/00

[52] U.S. Cl. ..... 493/355; 493/287; 493/370; 493/396; 493/403

[58] Field of Search ..... 493/352, 355, 369, 370, 493/396, 403

[56] References Cited

U.S. PATENT DOCUMENTS

| | | | |
|---|---|---|---|
| 1,494,604 | 5/1924 | Jones | 493/355 |
| 2,982,186 | 5/1961 | McKeen | 493/362 |
| 3,058,868 | 10/1962 | Schroeder | 493/331 |
| 3,073,216 | 1/1963 | Gaunt | 493/340 |
| 3,074,327 | 1/1963 | Grahn | 493/362 |
| 3,432,375 | 3/1969 | Rein | 493/405 |
| 3,495,507 | 2/1970 | Haas et al. | 493/287 |
| 3,654,842 | 4/1972 | Schwenk | 493/287 |
| 3,779,786 | 12/1973 | Tone | 493/370 |
| 4,645,484 | 2/1987 | Niske | 493/370 |
| 4,708,708 | 11/1987 | Fries | 493/357 |

*Primary Examiner*—William E. Terrell
*Attorney, Agent, or Firm*—Burns, Doane, Swecker & Mathis

[57] ABSTRACT

Bend lines on packaging material are obtained by creasing, which results in crease lines which are raised on one side of the material. According to the invention the raised parts of the crease lines are removed by mechanical processing, such as by milling, considerably increasing the crease lines' weakening effect on the packaging material and facilitating subsequent bending of the material.

17 Claims, 3 Drawing Sheets

METHOD OF OBTAINING BEND LINES ON PACKAGING MATERIAL

FIELD OF THE INVENTION

The present invention concerns a method of obtaining bend lines on packaging material.

BACKGROUND OF THE INVENTION

Consumer packagings for drinks such as juice and milk are often manufactured from a flexible packaging material which, through cutting, bending and sealing, is formed into a filled and closed packaging container of the desired shape. The packaging material is usually a laminate which contains a bearer layer of fibrous material, e.g. paper, which is coated at least on one side, facing the contents, with a liquid-tight, thermoplastic material. The packaging laminate can also contain another layer of plastic or metal foil to ensure a better lightproof quality, gas barrier or tolerance of liquids. While the packaging material is still in strip or sheet form it is usually also provided with a pattern of bend lines or fold lines which weaken the material linearly and facilitate the forming of the same into packaging containers of the desired shape by bending. The bend or crease lines are obtained in the conventional manner, that is to say through the packaging material in strip form being passed between rollers with male and female tools, which press the desired pattern of crease lines into the material. The fold line pattern obtained thus exhibits a positive and a negative side, i.e. the linear deformation of the material caused by the fold tool results in raised fold lines on the one, positive side of the material and corresponding linear depressions on the opposite, negative side of the material. The weakening of the material obtained through the creasing process is caused by the fact that the fiber layer of the material is distorted so that the fibers in the region of the crease line are displaced in a wave-like manner, but are not broken off or cut off. No real reduction in the thickness of the material in the crease line takes place, but only a displacement of the material from the negative side to the positive side. Conventional crease lines thus give a linear weakening of the material, but the elasticity of the material is to a large extent retained, since no reduction in the material thickness in the crease lines and no cutting off of fibers takes place. The crease lines certainly achieve thereby a simpler and more precise process of bending, but the material retains its elasticity and, in the absence of external forces, it attempts to straighten out again to the original, mainly flat position. Conventional, folded crease lines do offer a sufficient weakening of the material for the majority of purposes, but when extra high demands are made for accurate shaping of the packaging or sharp, straight bends, a further weakening of the material is required, which not only facilitates the bending but also "kills" the elasticity of the material so that the material, to the greatest possible extent, remains in the folded position in the absence of external forces.

In packaging laminates which contain a central bearer layer of fibrous, liquid-absorbent material, it is a well known practice to ensure a folding over of the longitudinal edge of the strip of packaging material which, after being shaped into a packaging container, is coated on the package interior to prevent harmful contact with the contents in liquid form. The folding over of the edge of the strip of packaging material is done in several stages. First, a milling or grinding of the edge is carried out with the aim of reducing the material thickness so that the thickness of the edge after folding over is mainly the same as the total thickness of the material. Then the area of reduced thickness is provided with a longitudinal crease line mainly extending centrally in this area, after which the edge is doubled over and sealed within the area of reduced thickness. With certain types of material and material thicknesses it has proved difficult with conventional folding to ensure a sufficiently great weakening to make sure that the edge that is folded over remains in the doubled over position until the sealing has been completed. This has resulted in the width of the folded area being successively reduced so that finally the edge remains unfolded, which, if it is not detected, causes suction of the edge and leakage in the finished packaging container.

Bend lines which weaken the material to a greater extent than conventional crease lines can be achieved with the aid of a well known method, which is also used for reduction of thickness of larger material parts, e.g., in joints overlapping each other. In this method one side of the strip of packaging material is subjected to a milling or grinding process at the same time as the strip of material passes through a master tool, i.e. a tool which is provided with a pattern of the raised areas which serve as a holder in the milling and grinding process. For rational use several master tools must be applied on a counter roll and the master tools must be given individual shape for each type of weakening pattern that must be ground on the material, which is shown to be unreasonably expensive in manufacturing the packaging material for a large number of different types or sizes of packaging containers. In addition the method gives a line with worse definition, i.e. the transition from the ground area to the adjacent, unground area of the packaging material is gradual and not distinct.

A further manner of ensuring weakened or thinned areas of material is to use a conventional grinding or milling which results in a pattern of recessed grooves in one side of the material. These grooves serve as indications for folding, but they are very badly defined with sliding transfer to the unground material and therefore give badly defined, crooked crease lines. The method further entails a considerably greater removal of the fiber material, which produces great quantities of shavings that have to be handled.

There is thus a need within the packaging material industry to ensure a method which can provide at a reasonable cost a packaging material with well defined crease lines in a desired pattern.

OBJECTS AND SUMMARY OF THE INVENTION

An aim of the present invention is to ensure a method of achieving crease lines on packaging material, with this method not being affected by the disadvantages of the abovementioned, previously known methods but providing shaping of well defined crease lines in the desired pattern on different types of packaging material and laminate.

A further aim of the present invention is to ensure a method by means of which it is possible to ensure crease lines which not only weaken the material so that the folding is facilitated but also, to a certain extent cut the fiber layer of the material so that the tendency of the material after folding to return to its original position is reduced.

A further aim of the present invention is to ensure a method of achieving crease lines on the packaging material, with this method being simple and rational to carry out and adapt to different types of material and packagings and in addition being cheap and uncomplicated.

The aforementioned and other objects are achieved through a method of forming crease lines on packaging material according to the present invention. The method includes a first stage during which the material is provided with a desired pattern of raised parts on one side of the material, and a second stage during which the material is subjected to a mechanical processing.

Further embodiments of the method according to the invention area given the characteristics that can be seen from the sub-claims.

BRIEF DESCRIPTION OF THE DRAWINGS

A preferred embodiment of the method according to the invention will be described more closely below with particular reference to the enclosed drawing, which only shows the details indispensable for understanding the invention.

DETAILED DESCRIPTION

Figure 1:
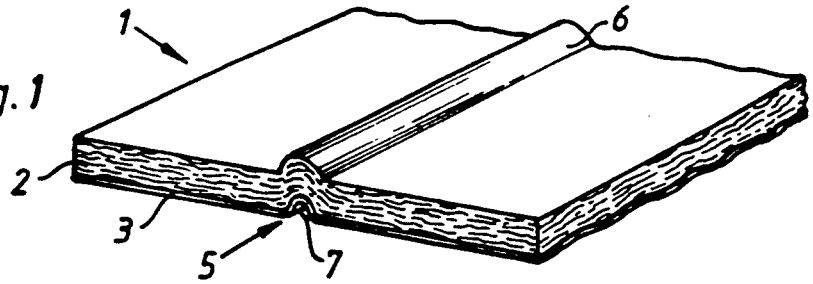
FIG. 1 is a perspective view of a section of packaging material which, in accordance with the method according to the invention, has been provided with a raised part.
Figure 2:
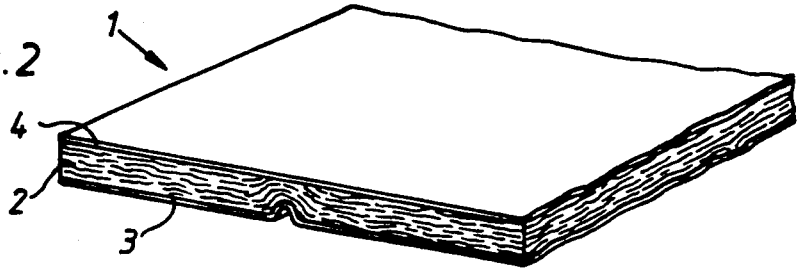
FIG. 2 is a perspective view of a section of packaging material according to FIG. 1 which has been mechanically processed in accordance with the method according to the invention.
Figure 3:
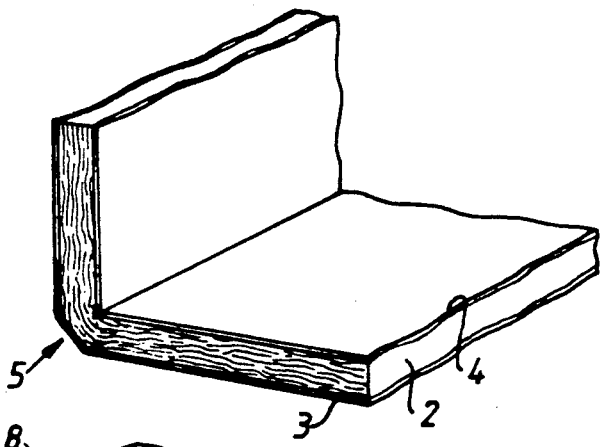
FIG. 3 is a perspective view of a section of the packaging material according to FIG. 2 after folding along a crease line achieved according to the invention.

The method according to the invention is, as previously mentioned, intended to be used in order to achieve fold lines on packaging material of different sorts, such as packaging material of the sort used for production of consumer packagings for contents in liquid form, e.g. milk packagings. Even though the method according to the invention can be used with many different types of material, it is illustrated in the figures as used in its preferred embodiment. FIGS. 1, 2 and 3 thus show part of a packaging material (1) on the one hand in strip or sheet form FIGS. 1, 2, on the other during shaping into a packaging container FIG. 3 most. The packaging material (1) contains a relatively thick approximately 0.5 mm bearer layer (2) of fibrous material, usually paper. The packaging material (1) is, as already mentioned, designed to be used for manufacture of packaging containers for contents in liquid form and must contain in its final form, further layers of liquid-tight material. An outer layer (3) of thermoplastic material may be laminated to one side of the bearer layer (2) as in FIG. 1. Usually this layer is made of polythene, but other types of thermoplastic can also be envisaged. The liquid-tight layer (3) can alternatively be applied to one side of the bearer layer at a later stage, possibly at the same time that a further layer (4) is applied to the opposite side of the bearer layer (2). The layer (4) can also consist of suitable thermoplastic material and be applied through extrusion coating in a hot state or in the form of a prefabricated plastic film.

In order to facilitate the shaping of the packaging material (1) in sheet or strip form into finished, e.g. parallelepiped-shaped packaging containers, the packaging material is provided with a pattern of crease lines (5) which weaken the material linearly and facilitate rectilinear folding of the material so as to form the edges and corners of the packaging container. The crease lines (5) are preferably linear, but can also have the form of surfaces or regions of larger area, consisting of where the crease lines meet or cross each other, in corner parts, sealing regions etc. Preferably the lines are obtained through conventional creasing consisting of the packaging material being passed through a male and a female tool at, for example, a crease line forming station 21 which press the material between them so that it is given a positive side, on which the crease lines (5) exhibit raised parts (6), and also side, on which the crease line has the form of a depression (7). This distortion or deformation of the packaging material entails that the fibers in the bearer layer (2) are given a corresponding deformation and thus run partly up through the raised part (6) of the crease line (5), which is illustrated in FIG. 1. The raised part (6) of the crease line (5) is thus obtained preferably by rolling the packaging material between fold rollers at the crease line forming station 21, but other types of pressing procedures can also be envisaged.

When the packaging material according to the first stage of the invention is provided with the raised parts (6) in the desired pattern, preferably linear, a second stage is carried out in accordance with the invention in which the material (1) is subjected to a mechanical processing which wholly or partly removes the raised parts (6). The processing, which in the first embodiment of the invention, the results of which processing are illustrated in FIGS. 1–3, is preferably a face milling of the positive side of the material (1) at, for example, a coating station 41, principally removes altogether the raised parts (6) and is terminated when these are reduced to an equal height with the adjacent, mainly flat surface of the material. The positive side of the material thereby becomes completely flat and can, as illustrated in FIG. 2, subsequently be coated with the second, liquid-tight layer (4) of thermoplastic material, such as polythene at, for example, a coating station 41. Through the mechanical, chip-removing processing of the positive side of the packaging material, those parts of the bearer layer's fibres are removed which extend upwards in the raised part (6), and the packaging material therewith obtains fold lines in which the fibre layer (2) is not only deformed and weakened but also reduced in thickness, which reduces the elasticity of the material so that it acquires, after folding, an increased tendency to remain in the folded position. This is illustrated in FIG. 3, where the packaging material according to FIG. 2 is folded ninety degrees along the crease line (5) during shaping into a packaging container. The forming of the crease lines in accordance with the method according to the invention results in well defined and distinct crease lines which considerably reduce the flexibility and elasticity of the material and thereby make it possible to achieve rectilinear folds along the edges of the packaging container with greater accuracy, which gives the packaging container a more even, cleaner appearance and in consequence of this a better handling rigidity.

Figure 4:
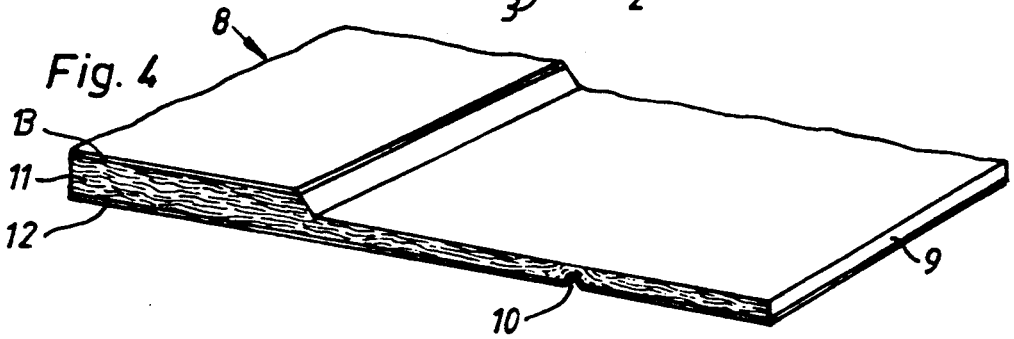
FIG. 4 is a perspective view of a section of packaging material with a crease line achieved in accordance with the method according to the invention in another type of packaging material.
Figure 5:
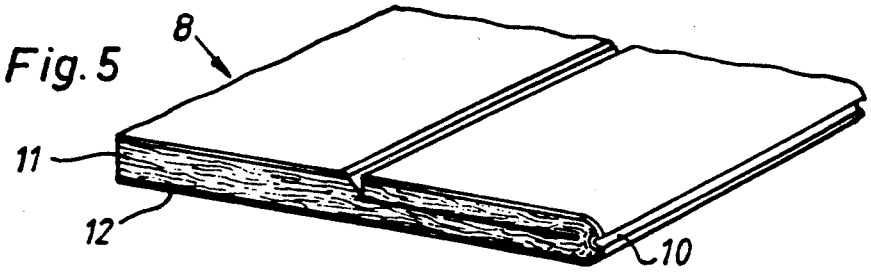
FIG. 5 is a perspective view of a section of packaging material according to FIG. 4 after folding over of a longitudinal edge.
Figure 6:
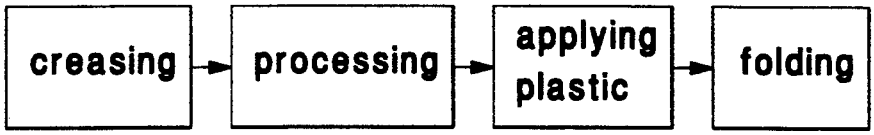
FIG. 6 schematically shows a method according to an aspect of the present invention.
Figure 7:
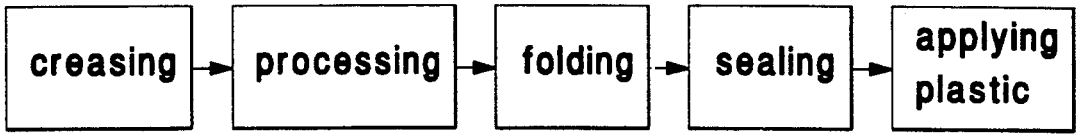
FIG. 7 schematically shows a method according to a further aspect of the present invention.
Figure 8:
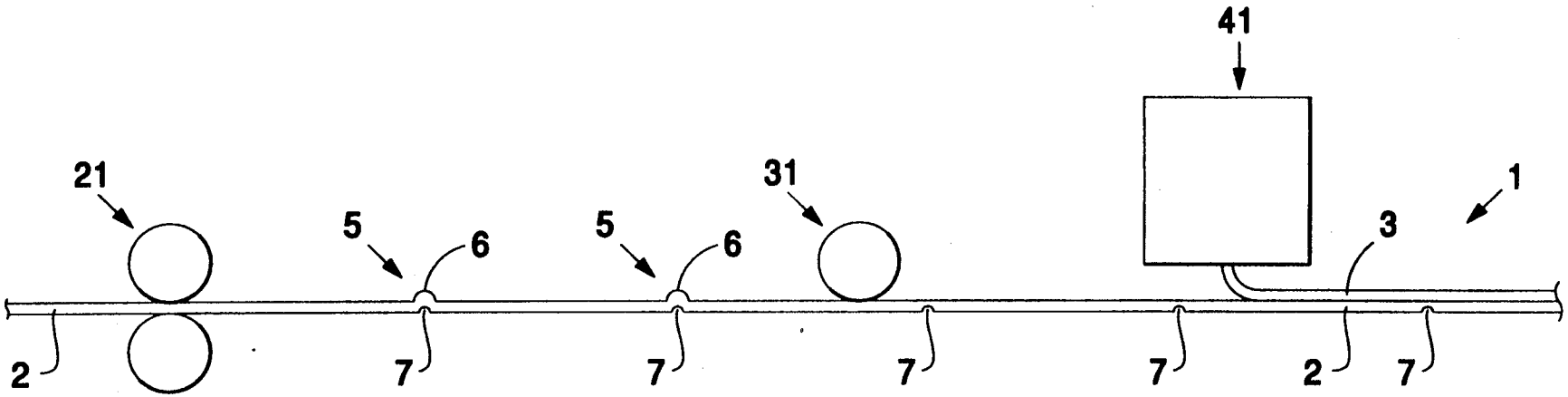
FIG. 8 is a schematic view of the method for forming crease lines according to an embodiment of the invention.

Another embodiment of the method according to the invention is illustrated in FIGS. 4 and 5. A packaging material (8) in strip or sheet form, which can be of the same type as the packaging material (1), must in accordance with the method according to the invention be provided with a crease line (10) extending along a longitudinal edge (9). The crease line (10) is provided to enable folding over of the edge region to prevent the fibrous bearer layer (11) of the packaging material from absorbing the liquid contents of the package along the longitudinal edge (9), which, after shaping of the packaging material into the packaging container, is situated inside the packaging container, the edge being in contact with the liquid contents of the package. So-called flaking technology is usually employed when folding over the narrow edge regions of the strips of packaging material. This usually involved reducing by half the thickness of the edge region in order to prevent the edge from becoming thicker than the original thickness of the packaging material after folding over.

The reduction of the thickness is done through grinding or milling or by means of a rotating knife edge which the material is made to pass in conjunction with the manufacture. In accordance with the method according to the invention the packaging material (8) is provided with the crease line (10) before the mechanical, thickness-reducing processing. The crease line (10), which is preferably formed with the aid of two rollers provided with male and female bending tools working in conjunction, is placed so that the positive, raised side is situated on the side of the packaging material (8) which is to be processed. The subsequent, thickness-reducing processing therefore removes both the raised part of the crease line (10) and adjacent parts of the packaging material (8) so that the thickness of the edge region in its entirety amounts to approximately half the original thickness. The packaging material (8) may at this stage of manufacture, already be coated in the known and previously described manner, with external layers (12), (13) of thermoplastic material, but it is also possible to apply one or both of these layers at a later stage. As soon as the mechanical, thickness-reducing processing of the edge region of the packaging material (8) has taken place a 180 degree folding of the edge region along the crease line (10) is carried out in a manner which is in itself well known, after which the folded part is sealed in the folded position with the aid of a suitable binding agent usually a hot melt. The folding must be done in a straight line and parallel along the longitudinal edge (9), which is considerably facilitated by the well defined fold line achieved according to the invention, which has a high material-weakening effect and which, due to the removal of the raised part and the simultaneous cutting off of material fibers reduces the elasticity of the material to a sufficient extent that the folded edge region remains in this position until its gluing has been completed. Through this an even, folded-round edge of material is ensured which gives a satisfactory watertightness, enables a perfectly good sealing of the material after the shaping of the same into a packaging container and guarantees a seal against contents penetrating into the fiber layer (11).

The method according to the invention, in its various embodiments, be used to obtain well defined crease lines in different types of packaging material for various purposes. Compared with earlier, conventional bending technology a considerably stronger and more permanent weakening of the material is achieved. Compared with earlier grinding technology in combination with master tools a more well-defined fold region is obtained, and, at the same time, cost is considerably reduced, since no master tool is necessary. In comparison with conventional grinding without master tools a considerably better definition of the weakening lines is achieved according to the invention without the technology requiring significantly more work or costs.

While this invention has been illustrated and described in accordance with a preferred embodiment, it is recognized that variations and changes may be made therein without departing from the invention as set forth in the claims.

What is claimed is:

1. A method of achieving crease lines on packaging material comprising the steps of:

passing the material between a pair of forming rollers to form a desired pattern of raised parts on a first side of the material:

moving the material on which the raised parts are formed from contact with both of the rollers forming the pair; and subsequently processing the material on which the raised parts are formed to at least partially remove that portion of the material forming the raised parts.

2. The method according to claim 1, wherein the raised parts are linear.

3. The method according to claim 2, wherein the raised parts are formed by creasing the material.

4. The method according to claim 1, wherein the processing includes a chip-removal operation.

5. The method according to claim 1, wherein the raised parts are processed to the same height as the adjacent surface of the material.

6. The method according to claim 1, wherein the processing reduces the material thickness both in the raised parts and in adjacent parts of the material.

7. The method according to claim 1, comprising the further step of applying to the processed side of the material a layer of plastic material.

8. The method according to claim 7, wherein the layer of plastic material is applied in the form of a film.

9. The method according to claim 7, wherein the layer of plastic material is applied in the form of a coating.

10. A method of forming crease lines in packaging material comprising the steps of: pressing a sheet of packaging material with pressing means along a predetermined line to form a depression on a first side of the material and a raised part along said line on a second side of the material, moving the sheet of packaging material from contact with the pressing means, and subsequently removing that part of the material forming said raised part to form a flat surface on said second side.

11. The method according to claim 10 comprising the further step of applying plastic material to said second side after said removing step.

12. A method of forming folds in packaging material comprising the steps of:

pressing a sheet of packaging material with pressing means along a line to form a depression on a first side of the material and a raised part along said line on a second side of the material;

moving the material from contact with the pressing means;

subsequently reducing the thickness of the material on a second side of the material by removing material on the second side of the material over a width of the material extending from an edge of the material to a distance from the edge of the material; and folding the reduced thickness material in half such that the depression forms an outside corner of a fold.

13. The method according to claim 12, wherein the material thickness is reduced by approximately one half of the thickness of the material.

14. The method according to claim 12, wherein the material thickness is reduced by rotating knife means.

15. The method according to claim 12, comprising the further step of sealing the folded reduced thickness material together.

16. The method according to claim 15, wherein the folded, reduced thickness material is sealed together by a hot melt adhesive.

17. The method according to claim 15, comprising the further step of applying a thermoplastic material over the sealed, folded reduced thickness material.

* * * * *